US006337667B1

(12) United States Patent
Ayala et al.

(10) Patent No.: US 6,337,667 B1
(45) Date of Patent: Jan. 8, 2002

(54) MULTIBAND, SINGLE FEED ANTENNA

(75) Inventors: Enrique Ayala; Juan Zavala, both of Watsonville; Rob Hill, Salinas, all of CA (US)

(73) Assignee: Rangestar Wireless, Inc., Aptos, CA (US)

( * ) Notice: Subject to any disclaimer, the term of this patent is extended or adjusted under 35 U.S.C. 154(b) by 0 days.

(21) Appl. No.: 09/711,263

(22) Filed: Nov. 9, 2000

(51) Int. Cl.[7] ..... H01Q 1/24; H01Q 9/16
(52) U.S. Cl. ..... 343/795; 343/702; 343/806
(58) Field of Search ..... 343/795, 793, 343/700 MS, 702, 895, 803, 801, 806, 818; H01Q 1/24, 9/16

(56) References Cited

U.S. PATENT DOCUMENTS 6,140,146 A * 10/2000 Brady et al. ..... 438/62
6,204,826 B1 * 3/2001 Rutkowski et al. ..... 343/895
6,249,255 B1 * 6/2001 Eggleston ..... 343/702

* cited by examiner

*Primary Examiner*—Hoanganh Le
(74) *Attorney, Agent, or Firm*—Fulbright & Jaworski L.L.P.

(57) ABSTRACT

A multiband antenna operates in at least a first frequency band and a second frequency band, a higher frequency band. A dipole has a first conductive leg and a second conductive leg and may be directly fed between the first and second legs. At least a portion of the first leg of the dipole has a meander configuration. The first leg has an electrical length of about one-quarter wavelength, or an odd multiple thereof, in the first frequency band and the second leg has an electrical length of about one-quarter wavelength, or an odd multiple thereof, or more in the first frequency band. A non-driven parasitically-excited conductive element is closely spaced to the first dipole leg and is electrically connected to the second dipole leg. The parasitic element has an electrical length of about one-quarter wavelength, or an odd multiple thereof, in the second frequency band.

57 Claims, 8 Drawing Sheets

MULTIBAND, SINGLE FEED ANTENNA

BACKGROUND OF THE INVENTION

1. Field of the Invention

The present invention relates to multiple frequency band (multiband) antennas, particularly compact multiband antennas for wireless communication devices (WCDs), such as cellular telephones, portable (laptop) computers, hand-held computers, and the like. In one practical embodiment, the present invention relates to UHF (ultra-high frequency) and SHF (super-high frequency) antennas for WCDs that provide operation in multiple frequency bands while having only a single feed point.

2. Description of Related Art

There is an increasing demand for wireless devices that are capable of communicating in multiple frequency bands. For example, a wireless device configured for the United States and European markets may require the ability to operate in four bands: the European cellular telephone band (880–960 MHz), the United States PCS band (1850–1990 MHz), the Bluetooth band (2.4–2.5 GHz) and the 802.11A unlicensed band (5.15–5.25 GHz).

Various multiband single feed line antennas are known in the art. Some are designed for use at HF or VHF and are configured so that they are unsuitable for reduction in size for use in a wireless device. Others, although UHF and/or SHF antennas designed for use in small spaces, are complex, do not readily permit more than two or three bands of operation, do not permit multiband operation without interaction among the bands, are unsuitable for implementation as conductive traces on a printed circuit board (PCB), and/or are expensive to manufacture.

Accordingly, there remains a need for multiband single feed antennas, particularly small multiband single feed UHF and SHF antennas suitable for use in wireless communication devices.

SUMMARY OF THE INVENTION

In a first aspect, the invention is directed to a multiband antenna operable in at least a first frequency band and a second frequency band higher in frequency than the first frequency band (the second frequency band need not be an odd multiple of the first frequency band). The multiband antenna includes a dipole having a first conductive leg and a second conductive leg and is adapted to be directly fed between the first and second legs. At least a portion of the first leg of the dipole has a meander configuration. The first leg has an electrical wavelength of about one-quarter wavelength (or an odd multiple thereof) in the first frequency band and the second leg has an electrical wavelength of about one-quarter wavelength (or an odd multiple thereof) or more in the first frequency band. The multiband antenna further includes a non-driven parasitically-excited conductive element closely spaced to the first dipole leg and electrically connected to the second dipole leg. The parasitic element has an electrical wavelength of about one-quarter wavelength (or an odd multiple thereof) in the second frequency band.

In a preferred embodiment, the dipole legs and parasitic element are conductive traces on a thin dielectric such as a printed circuit board. Only a single dielectric layer is required. The traces can be on the same side of the printed circuit board and the antenna can also include either one or two further conductive traces on the other side of the printed circuit board. One of the further conductive traces, if present, is electrically connected to the second leg of the dipole and extends under at least a portion of the second leg, under at least a portion of the gap between the dipole legs, under a portion of the first leg, and under a portion of the parasitically-excited element. The other of the further conductive traces, if present, has no electrical connection to any other traces on the printed circuit board and extends under a portion of parasitic element and under a portion of the space between the first leg and the parasitically-excited element.

In a practical embodiment of the first aspect of the invention, the first frequency band is the 880–960 MHz band and the second band is the band of frequencies between 1850 MHz and 2.5 GHz that includes the 1850–1990 MHz band and the 2.4–2.5 GHz band. Such an antenna, having a wide second band, can be characterized as a three-band rather than a two-band antenna. The antenna dimensions can be scaled to provide operation in other frequency bands. For example, the first frequency band can be the 880–960 MHz band and the second frequency band can be the 1850–1900 MHz band or, the first frequency band can be the 1850–1900 MHz band and the second frequency band can be the 2.4–2.5 GHz band.). Scaling for yet other frequency bands is possible.

In a second aspect, the invention is directed to a multiband antenna operable in at least a first frequency band and a second frequency band higher in frequency than the first frequency band, (the second frequency band need not be an odd multiple of the first frequency band). The multiband antenna includes a dipole having a first leg and a second leg, and is adapted to be directly fed between the first and second legs. At least a portion of the first leg of the dipole has a meander configuration. The first leg has an electrical wavelength of about one-quarter wavelength (or an odd multiple thereof) in the first frequency band and the second leg has an electrical wavelength of about one-quarter wavelength (or an odd multiple thereof) or more in the first frequency band. The legs of the dipole can be conductive traces on the first side of a thin dielectric. Only a single dielectric layer is required. A further conductive trace can be located on the second side of the dielectric underneath a portion of the meander portion of the first leg. The further conductive trace has no connection to any other trace. The trace itself (not taking its proximity to the meandering dipole leg into account) has no resonance in the first and second frequency bands or any odd multiple thereof. The further conductive trace is shaped, sized and positioned under the meander portion so as to create an LC trap that electrically decouples the distal portion of the first leg when the antenna operates in the second frequency band such that the remaining portion of the first leg has an effective electrical length of about one-quarter wavelength (or an odd multiple thereof) in the second frequency band. The LC trap itself may or may not be resonant in the second frequency band.

In a practical embodiment, at least a portion of the meander-configured first leg portion folds back on itself at least twice and the further conductive trace is located underneath that portion of the first leg. The meander portion that folds back on itself at least twice can have three segments generally parallel to each other in which at least two of the segments are substantially linear.

In a practical embodiment of the second aspect of the invention, the first frequency band is the 880–960 MHz band and the second band is the 5.15–5.25 GHz band. The antenna dimensions and/or LC trap characteristics can be scaled to provide operation in other frequency bands. For example, the first frequency band may be the 880–960 MHz band and the second frequency band may be the 1850–1900 MHz band or, the first frequency band may be the 1850–1900 MHz band and the second frequency band may be the 2.4–2.5 GHz band.). Scaling for yet other frequency bands is possible.

In a third aspect, the invention is directed to a multiband antenna operable in at least a first frequency band, a second frequency band higher in frequency than the first frequency band (the second frequency band need not be an odd multiple of the first frequency band) and a third frequency band (the third frequency band need not be an odd multiple of the first frequency band or the second frequency band) higher in frequency than the first and second frequency bands. The multiband antenna includes a dipole having a first leg and a second leg, adapted to be directly fed between the first and second legs. At least a portion of the first leg of the dipole has a meander configuration and the first leg has an electrical wavelength of about one-quarter wavelength (or an odd multiple thereof) in the first frequency band and the second leg has an electrical wavelength of about one-quarter wavelength (or an odd multiple thereof) or more in the first frequency band. A non-driven parasitically-excited element is closely spaced to the first dipole leg and is electrically connected to the second dipole leg. The parasitic element has an electrical wavelength of about one-quarter wavelength (or an odd multiple thereof) in the second frequency band. The dipole and the parasitically-excited element can be conductive traces on the same side of a thin dielectric. Only a single dielectric layer is required. A further conductive trace can be located on the second side of the printed circuit board underneath a portion of the meander configuration. The further conductive trace, if present, has no connection to any other trace and itself has no resonance in the first, second and third frequency bands or any odd multiple thereof. The further conductive trace is shaped, sized and positioned under the meander portion so as to create an LC trap that electrically decouples a portion of the first leg when the antenna operates in the third frequency band such that the remaining portion of the first leg has an effective electrical wavelength of about one-quarter wavelength (or an odd multiple thereof) in the third frequency band.

The various antennas according to aspects of the present invention can have flexible conductive traces and can be formed on a flexible dielectric so that they can be bent and formed to fit into and around various objects in a restricted space.

If desired, the various antennas according to aspects of the present invention can provide the same nominal feedpoint impedance for all the frequency bands in which they are intended to operate, thus requiring no matching networks.

A single antenna for operation in multiple bands in accordance with aspects of the present invention can have a lower cost than multiple antennas and few assembly configurations.

Antennas according to aspects of the present invention can be made of printed circuit board material, thus having low cost, high availability and high reliability.

Antennas according to aspects of the present invention can have a single RF feed point, thus allowing a single feedline and avoiding the higher cost of multiple feedlines.

Practical implementations of aspects of the present invention can achieve a voltage-standing-wave ratio (VSWR) of less than 2.5–1 in all bands in which the antenna is intended to operate. Efficient radiation may be achieved, therefore lowering battery consumption.

Antennas according to aspects of the present invention can have a low, very thin, small size, and light weight allowing it to be embedded in restricted areas of a laptop (notebook) computer, for example in the hinge region.

DETAILED DESCRIPTION OF THE PREFERRED EMBODIMENTS

Figure 1:
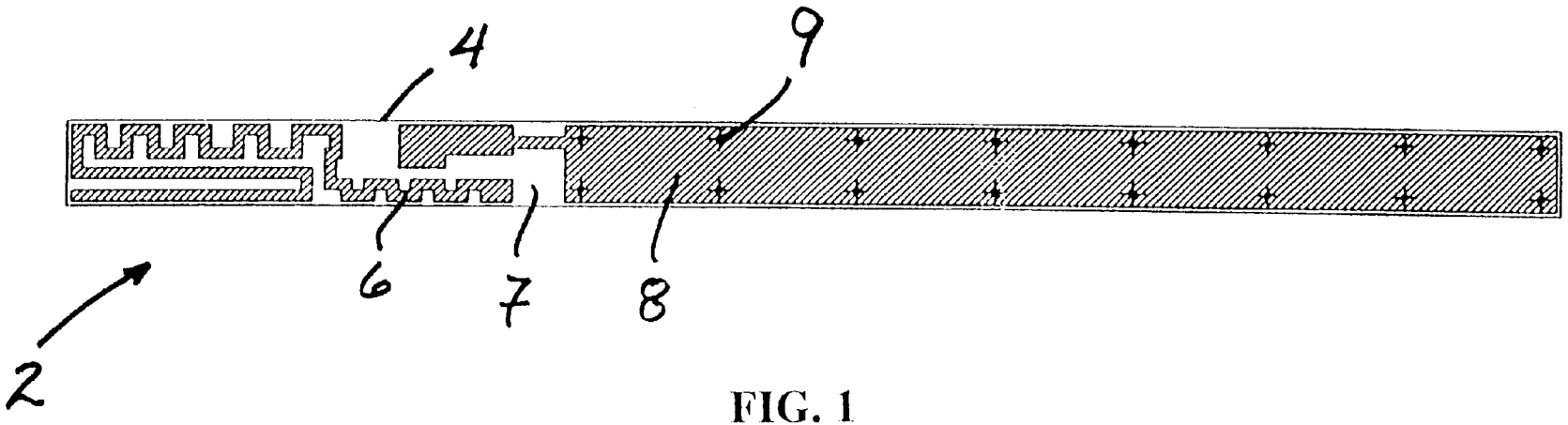
FIG. 1 is a plan view of the top side of a printed circuit board showing conductive traces that constitute portions of an antenna according to aspects of the present invention.
Figure 2:
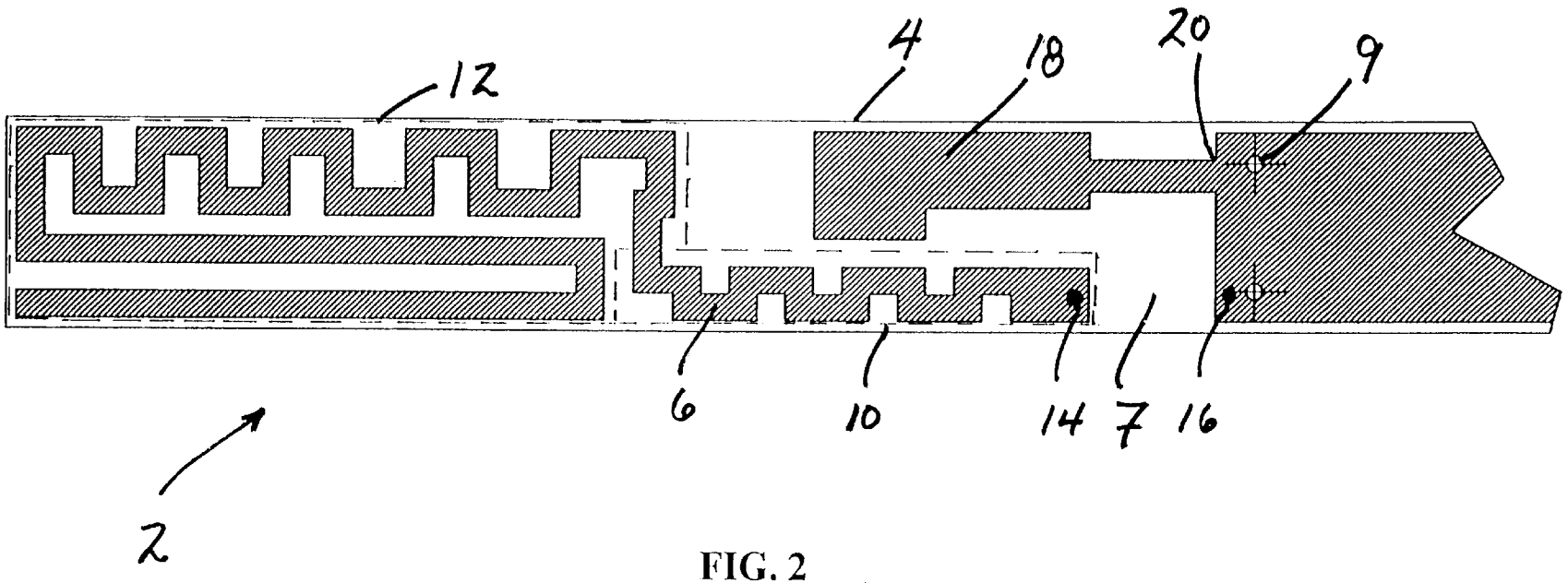
FIG. 2 is a magnified view of a portion of FIG. 1.
Figure 3:
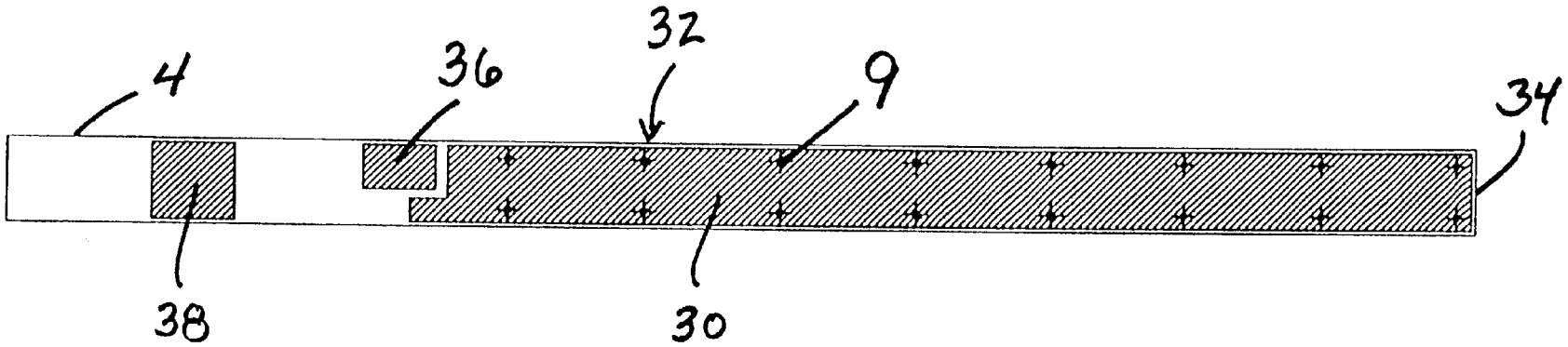
FIG. 3 is a plan view of the bottom side of the printed circuit board of FIG. 1 as it would be seen by looking through the board. Additional conductive traces are shown that constitute portions of an antenna according to aspects of the present invention.

An embodiment of a multiband antenna 2 according to the present invention is shown in FIGS. 1, 2 and 3. FIG. 2 is a magnified view of a portion of FIG. 1. FIGS. 1 and 2 show the first (top) side of a PCB. FIG. 3 shows the second (bottom) side of the PCB (as viewed through the top of the PCB). As shown, the antenna is configured as conductive traces on a printed circuit board 4. The traces can be copper, for example. PCB 4 can be made of any one of many suitable dielectric materials commonly used in PCB fabrication, such as Rogers 4003, GETEK, or FR4. One skilled in the art will understand that the optimal thickness for the PCB will vary according to the dielectric constant of the PCB material. In the practical embodiment described below, PCB 4 can be a Rogers 4003 board (which has a dielectric constant of 3) with a thickness of approximately 0.062 in./1.58 mm. The PCB can be rigid or flexible. A flexible PCB (with flexible conductive traces) would allow the antenna to be fit into curved or difficult spaces or, alternatively, to be placed on a curved surface such as a vehicle window. The antenna of the present invention in its various aspects can be configured as conductive traces or conductors on any thin solid dielectric, or as bare or insulated conductors in an air dielectric.

All aspects of the multiband antenna 2 comprise at least a dipole. A thin wire linear dipole would have too great a length in the lowest frequency band and would present too narrow a bandwidth for use in the frequency bands useful for a WCD. In practical embodiments of the present invention this size and bandwidth problem has been overcome by optimizing the length to diameter ratio of the antenna conductors and by employing a meander conductor pattern for at least a portion of some of the conductors.

As shown in FIGS. 1, 2 and 3, the printed circuit board 4 is long and narrow and carries a plurality of conductive traces on both of its sides. On the top side of the PCB, two of the traces form a dipole, preferably an asymmetric dipole, having a first conductive leg 6 and a second conductive leg 8. The first leg 6 preferably has an electrical length of about one-quarter wavelength in a first frequency band. Alternatively, it can have an electrical length that is an odd multiple of a quarter-wavelength in the first frequency band. The second leg 8 preferably has an electrical length of more than a quarter wavelength in the first frequency band. Alternatively, it can have an electrical length that is more than an odd multiple of a quarter-wavelength in the first frequency band. Alternatively, the dipole can be symmetric such that both legs have substantially the same electrical length in the first frequency band. If symmetric, the dipole leg conductors may require optimization of the length to diameter (or width) ratios in order to provide sufficient bandwidth in the lowest frequency band. Employment of a symmetric dipole also may require additional modifications, as described below.

The first conductive leg 6 has a meander configuration that includes a first portion 10 and a second portion 12. The first portion 10 has a back and forth meander pattern running generally along part of one of the long edges of the printed circuit board. Leg 6 then turns toward the other long edge of the printed circuit board where a second portion 12 has a back and forth meander pattern running generally along part of that other long edge of the printed circuit board to the narrow edge of the printed circuit board where it folds back upon itself twice. Thus, portion 12 has three segments generally parallel to each other in which at least two of the segments, the final two segments, are substantially linear. The configuration of portion 12 of the meandering first leg 6 was selected empirically to allow the dipole itself to operate in two frequency bands (using an LC trap, described below), which is the subject of second and third aspects of the invention. If that mode of operation is not desired, the folded back linear portions of the meandering leg 6 may be omitted and/or only a portion of the overall leg 6 need have a meander pattern (in that case, the particular meander pattern may vary substantially from the pattern shown in FIGS. 1 and 2 provided that the electrical length of the first leg 6 is about one-quarter wavelength in the first frequency band).

The second leg 8 of the asymmetrical dipole covers substantially all of a portion of the printed circuit board 4 from a point spaced by a gap 7 from the first leg 6 to the other narrow end of the printed circuit board. Preferably, leg 8 is linear or substantially linear and has a physical width that is large with respect to its length in order to widen the antenna bandwidth in the first and the second frequency bands. Alternatively, all or a portion of the second dipole leg 8 may have a meandering configuration.

Preferably, the asymmetric dipole legs 6 and 8 are fed across the gap 7 between them, such as at points 14 and 16, respectively. This can be a common feed point for operation in all of the frequency bands according to all aspects of the invention. The antenna, according to all aspects of the invention, can be configured to have substantially the same nominal feed point impedance in all its frequency bands of operation. A nominal impedance of 50 ohms, which is commonly employed for transmission of RF in WCDs, can be achieved. Preferably, the first and second legs of the dipole are split, as shown in FIGS. 1 and 2 so that an unbalanced feed line (not shown) (coaxial cable, for example) can be connected to the dipole such that the first leg is fed by the hot side )the center conductor of the coaxial cable, for example) and the second leg is fed by the ground side (the shield of the coaxial cable, for example) of the feed. Alternatively, leg 6 can be fed by a microstrip line and leg 8 can be connected to the ground system of the WCD in which it is embedded. If a feed line longer than a quarter wavelength at the highest frequency is employed, a balun should be employed. In the various aspects of the present invention, no matching network is required—the dipole can be directly fed. A split dipole feed is helpful in achieving the same nominal feed point impedance in all bands of operation without matching because it is not frequency sensitive as would be a gamma match, T-match or other matching arrangement that would have to be used if the dipole were not physically split.

In accordance with the first aspect of the invention, the dipole excites a parasitically-excited element to provide operation in at least two-frequency bands, a first frequency band and a second frequency band. One of the frequency bands can have a very wide bandwidth so as to include two frequency bands, thus providing, in effect, a three-band (triband) antenna. The second frequency band need not be an odd multiple of the first frequency band. A non-driven parasitically-excited conductive element 18 is closely spaced to the first portion 10 of the dipole leg 6 and runs generally parallel to portion 10 along the side of board 4 opposite portion 10 of dipole leg 6. Element 18 should be spaced closely enough to the dipole leg so as to be parasitically excited by the dipole in the frequency band in which element 18 operates. For example, if embodied in a PCB, it is believed that such excitation will occur when the closest portions of the parasitically-excited element and the first dipole leg are spaced by about 0.01 to 0.05 wavelength in the second frequency band. Element 18 is electrically connected to the second dipole leg 8 at region 20. Element 18 (up to its connection to dipole leg 8 at region 20) has an electrical length of about one-quarter wavelength in the second frequency band. Alternatively, it may have an electrical length that is an odd multiple of a quarter-wavelength in the second frequency band. Thus, the second dipole leg 8 has an electrical length greater than the electrical length of the non-driven parasitically-excited element in said second frequency band. It is believed that element 18 is parasitically excited by the asymmetric dipole as a result of electromagnetic coupling.

When the antenna operates in the second frequency band, it is believed that element 18 functions as a grounded parasitic asymmetric dipole leg in a manner similar to a quarter wave parasitically-excited monopole or "sleeve" element operating against a ground plane. However, in this case, dipole leg 8 is not a ground plane and is not perpendicular to element 18—element 18 and dipole leg 8 are collinear. When operating in the first frequency band, element 18 appears as an extension to the already longer asymmetrical second dipole leg 10 and has substantially no effect on operation in the first frequency band. Thus, operation in the two frequency bands can be independently optimized—tuning the antenna for operation in the first frequency band has little or no effect on turning the antenna for operation in the second frequency band and vice-versa. The configurations of the second leg and the non-driven parasitically-excited element are substantially similar—both are substantially linear. The physical width of the second dipole leg 8 is large with respect to its length in order also to widen the antenna bandwidth in the second frequency band.

As shown in figures, the parasitically-excited element 18 has three widths. In a first portion leading from the connection region 20, the element has a relatively narrow width. This narrow portion is coextensive with the feed point gap between the legs of the dipole. The element then widens as it runs parallel to the first leg 6 of the dipole. In the region of its end distal from region 20, it widens further. The shaping of element 18 was selected empirically to provide sufficient electromagnetic coupling between the elements along with an acceptable feed point impedance for the second frequency band and an acceptable VSWR in the wide bandwidth second frequency band. Other configurations are possible. The physical width of the parasitically-excited element 18 is large with respect to its length in order to widen its bandwidth. If embodied in a PCB, it is believed that a length-to-width ratio of element 18 in the range of about three to ten will result in such bandwidth widening, although other ratios may be workable depending on the desired results. The second frequency band can be wide so as to provide satisfactory operation in two frequency bands, such as the 1850–1990 MHz band and the 2.4–2.5 GHz bands. Such a wide bandwidth can be achieved by one or more of several factors: a PCB having a lower dielectric constant, the low length-to-width ratio of element 18, and one or more additional traces on the other side of the printed circuit board, as next described. Alternatively, the second frequency band need not have a wide bandwidth.

Coupling to the parasitically-excited element 18 along with the antenna characteristics in the second frequency band can be enhanced by selectively providing additional conductive traces on the other side of the printed circuit board 4. The reverse side of the printed circuit board as one would see it by looking through the printed circuit board is shown in FIG. 3 (in other words, the drawing is rotated 180 degrees along the long axis of the PCB 4 with respect to a true bottom plan view).

A first conductive trace 30 is underneath and coextensive with the second dipole leg 8 and also extends underneath at least a portion of the gap 7 between the dipole legs, preferably substantially all of the gap, a portion of the first dipole leg 6, and a portion of the narrowest portion of element 18. Trace 30 can be electrically connected to the second dipole leg 8 by a plurality of "vias" or conductors 9 that pass through the printed circuit board (only one of the vias 9 in each of FIGS. 1–3 is labeled to avoid cluttering the drawing figures). Most of the portion of trace 30 distal from its portion under element 18 is believed to have little or no effect on the operation of the antenna in any of the already described or to be described frequency bands. Thus, it is believed that most of the portion of the trace 30, say between about region 32 and end 34, may be omitted. In practice, a printed circuit board is easier to manufacture with the full version of trace 30 as shown in FIG. 3. The configuration of trace 30 in the region underneath the gap 7 between the dipole elements, underneath part of the first dipole element 6 and underneath a portion of element 18 is believed to affect the electromagnetic coupling between the dipole and the parasitically-excited element 18 and to affect the impedance match in the second frequency band.

A second underneath conductive trace 36, having a rectangular shape, is underneath a portion of element 18 and a portion of the space between dipole leg 6 and element 18. Trace 36 is not electrically connected to any other conductive trace. The configuration of trace 36 is believed to affect the coupling to the parasitically-excited element 18 and to affect the impedance match in the second frequency band. It is believed that some benefits may be obtained by employing conductive trace 30 without conductive trace 36 and vice-versa.

The antenna according to the first aspect of the present invention can provide operation with a low voltage standing wave ratio (VSWR) (i.e., below about 2.5–1) with linear polarization in two frequency bands. In a practical embodiment, the first frequency band is the 880–960 MHz band and the second frequency band is the band of frequencies between 1850 MHz and 2.5 GHz band that includes the 1850–1990 MHz band and the 2.4–2.5 GHz band. The antenna can be scaled for operation in other frequency bands. For example, the first frequency band can be the 880–960 MHz band and the second frequency band can be the 1850–1990 MHz band. Alternatively, the first frequency band can be the 1850–1990 MHz band and the second frequency band can be the 2.4–2.5 GHz band. In the case of the last two examples, the second frequency band is not a wide band, and, consequently, some or all of the band widening techniques described need not be employed (for example, element 18 may be narrower, the conductive traces on the second side of the PCB may be reconfigured or variously eliminated). Scaling for yet other frequency bands is possible.

A third underneath conductive trace 38 on the second side of the printed circuit board, shown in FIG. 3, relates to the second and third aspects of the invention and has no effect on operation in the first and second frequency bands and can be omitted when operation in yet an additional frequency band is not desired.

In accordance with a second aspect of the present invention, the asymmetric dipole can be employed along with the third conductive trace 38 in order to provide operation in two frequency bands. In that case, the parasitically-excited element 18 can be omitted along with the second underneath conductive trace 36. The first underneath conductive trace 30 can also be omitted, although it may be convenient for manufacturing purposes to provide a conductive trace substantially coextensive with and underneath the second dipole leg 8.

In the second aspect of the invention, the underneath conductive trace 38 is located underneath part of the second portion 12 of the first dipole leg 6. Conductive trace 38 has no connection to any other trace and, taken by itself, has no resonance in the first and second frequency bands or any odd multiple thereof. Conductive trace 38 is shaped, sized and positioned under the second portion 12 of the meandering dipole leg 6 so as to create, it is believed, an LC (inductive-capacitive) trap that electrically decouples the distal portion of the first leg when the antenna operates in the second frequency band such that the remaining portion of the first leg has an effective electrical length of about one-quarter wavelength, or an odd multiple thereof, in the second frequency band. The LC trap may or may not be resonant in the second frequency band. Thus, when fed at feed points 14 and 16, the asymmetrical dipole operates in two frequency bands, one determined by the full electrical length of dipole leg 6 and another determined by the LC trap electrically shortened length of dipole leg 6. Tuning the antenna for operation in the first frequency band is substantially independent of tuning the antenna for operation in the second frequency band and vice-versa. The shape, size, and position of conductive trace 38 under the second portion of the meandering first dipole leg have been found to affect the LC trap effect and characteristics. It is believed that the meandering pattern, in addition to providing a useful shortening of the dipole leg, provides the necessary inductance required for the LC trap. In the absence of such inductance, it is thought that the conductive trace 38 and the dipole leg separated by the PCB dielectric would act only as a parallel plate capacitor with very little associated inductance. While the meandering pattern shown in the figures provides sufficient inductance, other patterns may also be usable.

Thus, the full electrical length of the asymmetric dipole legs 6 and 8 provides operation in a first frequency band (preferably, 880–960 MHz). The LC trap electrically shortened length of dipole leg 6 along with dipole leg 8 provide operation in a second frequency band (preferably, 5.15–5.25 GHz). The trap effect resulting from the presence of conductive trace 38 has substantially no effect in other than the second frequency band. The antenna dimensions and/or LC trap characteristics may be scaled to provide operation in other frequency bands. For example, the first frequency band may be the 880–960 MHz band and the second frequency band may be the 1850–1900 MHz band or, the first frequency band may be the 1850–1900 MHz band and the second frequency band may be the 2.4–2.5 GHz band.). Scaling for yet other frequency bands is possible. The antenna according to the second aspect of the present invention can provide operation with a low voltage standing wave ratio (VSWR) (i.e., below about 2.5–1) with linear polarization in two frequency bands.

In a third aspect of the invention, all of the conductive traces shown in FIGS. 1–3 are employed in order to provide operation in three or four bands. Operation in two bands is provided by the asymmetric dipole and LC trap just described. The conductive trace 38 associated with the LC trap itself has no resonance in any of the three or four frequency bands. The parasitically-excited element 18 provides operation in one or two additional bands (preferably, it has a wide bandwidth—1850–2500 MHz, providing operation in the 1850–1990 MHz band and the 2.4–2.5 GHz band). Element 18 has substantially no effect in other than these one or two bands. Thus, tuning in any one of the multiple frequency bands is substantially independent of the others. The same nominal impedance, preferably 50 ohms, is presented at the gap 7 across the dipole elements in all of the bands. The antenna according to the third aspect of the present invention can provide operation with a low voltage standing wave ratio (VSWR) (i.e., below about 2.5–1) with linear polarization in three or four frequency bands.

As mentioned above, the dipole having legs 6 and 8 may be symmetrical (the dipole legs having substantially the same electrical length) rather than asymmetrical. In that case, if it is desired to operate the dipole in two frequency bands, LC traps should be located in both legs of the dipole. This would also require a modification of the dipole leg 8 so that is has at a meander configuration at least in part suitable for locating thereunder a further suitably configured, sized and located conductive trace. In the symmetrical dipole case, the parasitically excited element 18 should be reconfigured as a half-wave element with no connection to either dipole leg.

The practical embodiment of the antenna, shown in FIGS. 1, 2 and 3 is particularly adapted for embedding in the lid (screen-carrying portion) of a notebook computer near its hinge. For other applications allowing additional width, one or more additional frequency bands of operation can be added. For example, an additional parasitic element can be added on the side of the first dipole leg opposite element 18 (all being on the same side of the PCB 4). Such parasitic element would have a length that is an electrical quarter-wave in the desired frequency band of operation and would be electrically connected to the second dipole leg 8 in the manner that element 18 is connected. In addition, the underneath trace 30 can be extended under the additional parasitic element in the manner it extends under element 18. Furthermore, a further underneath trace, not electrically connected to any other trace, can be located in the region under the additional parasitic element in the manner of trace 36.

Figure 4:
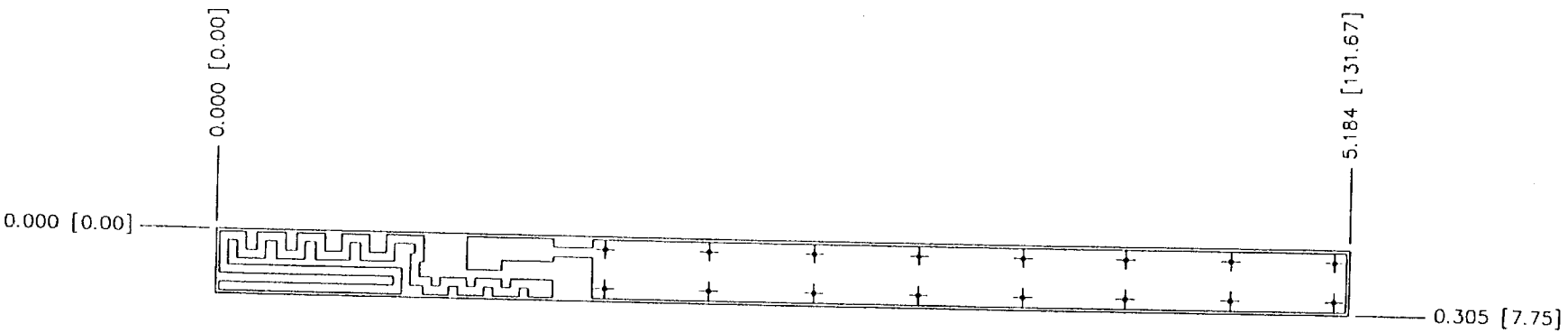
FIG. 4 is a plan view, similar to FIG. 1, showing the dimensions of the printed circuit board according to a practical embodiment of the invention.
Figure 5:
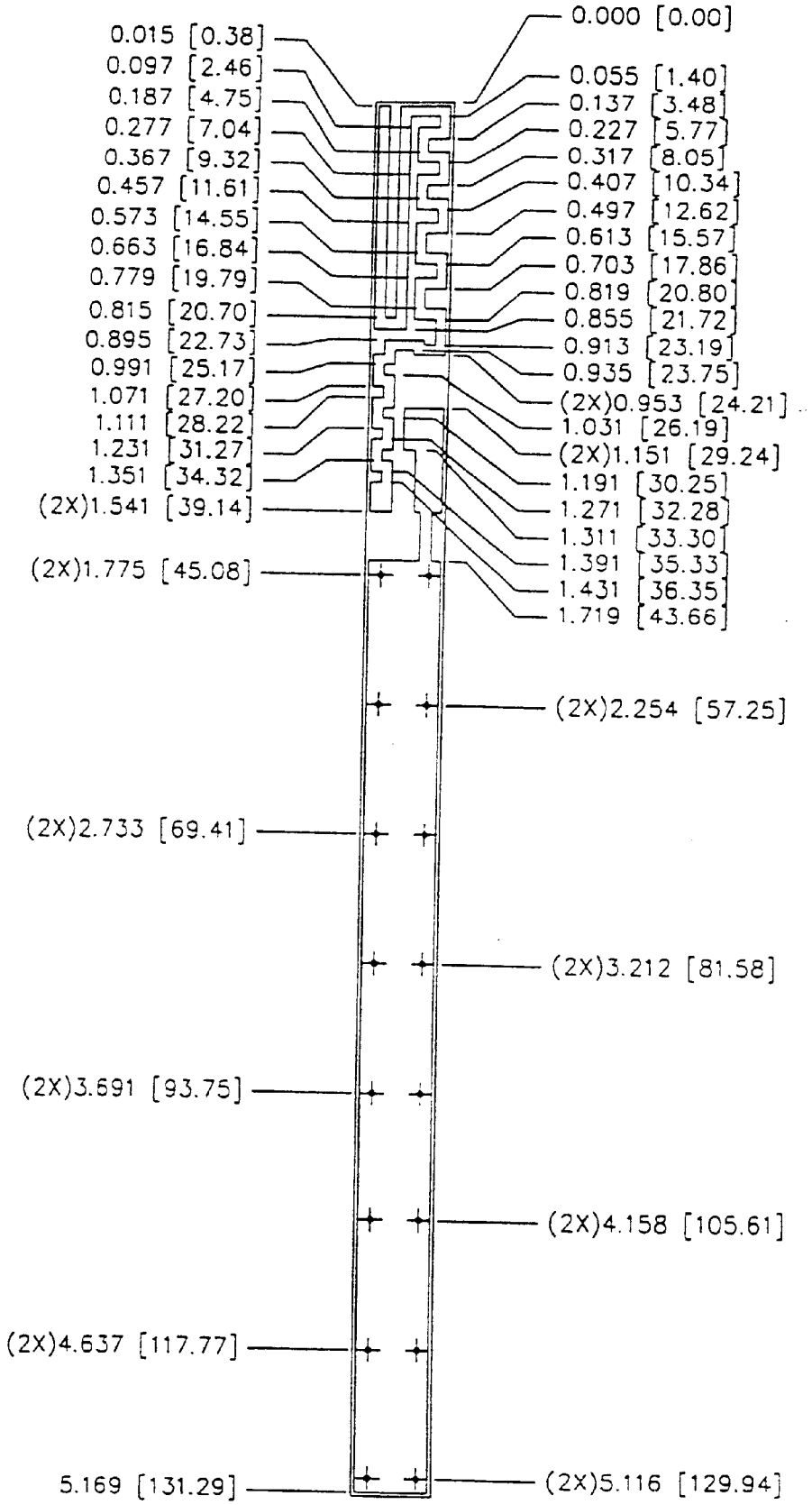
FIG. 5 is a plan view, similar to FIG. 1, showing the dimensions of the conductive traces lengthwise along the printed circuit board according to a practical embodiment of the invention.
Figure 6:
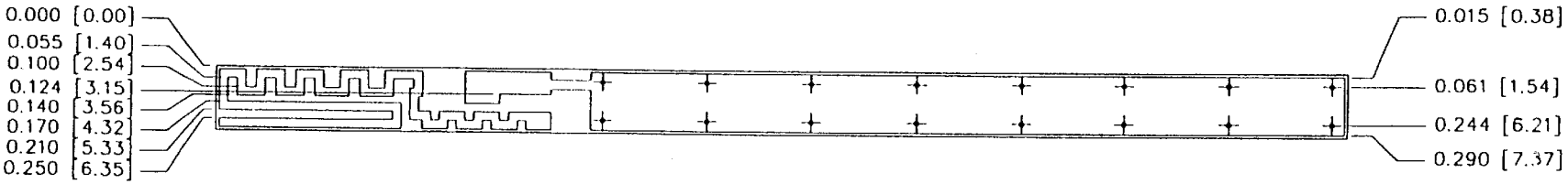
FIG. 6 is a plan view, similar to FIG. 1, showing the dimensions of the conductive traces crosswise across the printed circuit board according to a practical embodiment of the invention.
Figure 7:
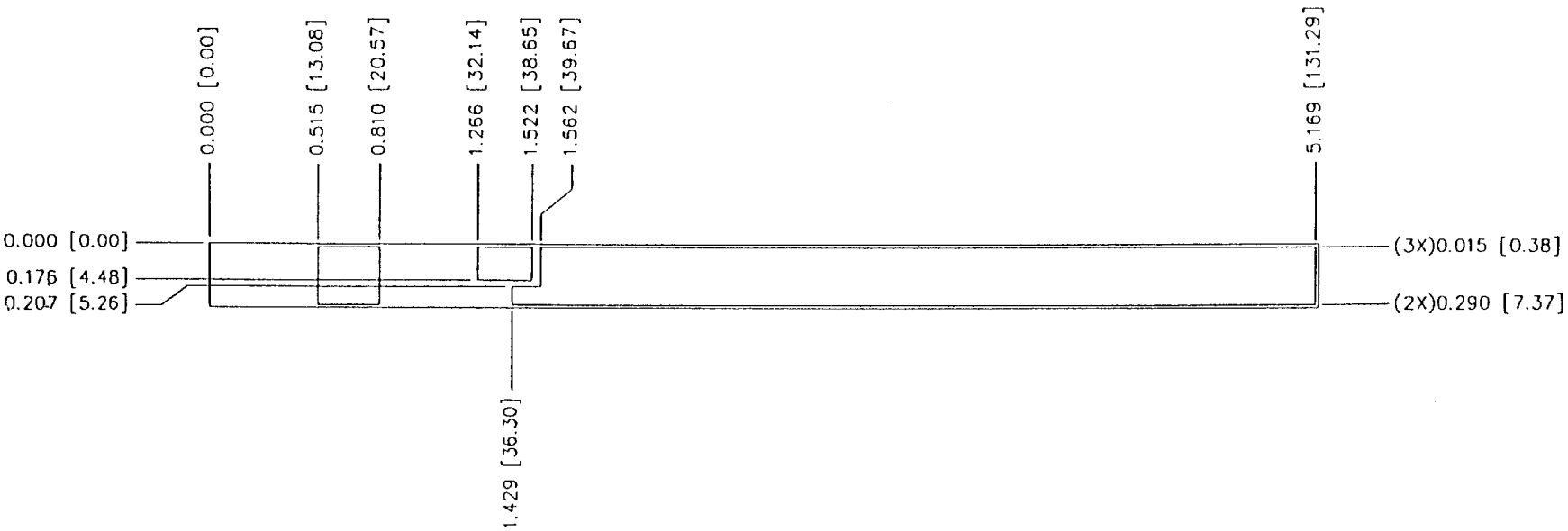
FIG. 7 is a plan view, as seen through the printed circuit board, showing the dimensions of the conductive traces on the bottom of the board.

The exact dimensions of a practical embodiment of the antenna of FIGS. 1–3 are shown in FIGS. 4, 5, 6 and 7. The origin is provided at one corner and the relevant X and Y distances of the structures are shown in inches and millimeters (in brackets). FIG. 4 shows the overall dimensions of the printed circuit board. FIGS. 5 and 6 show the dimensions of the conductive traces on the top side of the board. FIG. 7 shows the dimensions of the conductive traces on the bottom side of the board. As is the case with FIG. 3, FIG. 7 shows the conductive traces on the bottom side of the PCB as seen through the front side of the PCB. The PCB of the practical working example is a Rogers 4003 board (which has a dielectric constant of 3) with a thickness of approximately 0.062 in./1.58 mm.

Although the specific dimensions of an antenna operable in the 880–960 MHz, 1850–1990 MHz, 2.4–2.5 GHz, and 5.15–5.25 GHz bands is shown in FIGS. 4–7, one of ordinary skill in the art will understand that variations in PCB thickness, PCB board material, variations in trace conductivity, and other variations in implementation may require adjusting the tuning in various ones of the frequency bands by employing routine experimentation. Likewise, scaling the antenna for other bands may require some degree of routine experimentation to tune the antenna for various frequency bands. For example, it may be necessary to adjust the relative sizes, spacings, and geometries of the conductive traces and/or it may be necessary to change the dielectric materials used in the manufacture of the PCB, or to vary the thickness of the PCB.

Figure 8:
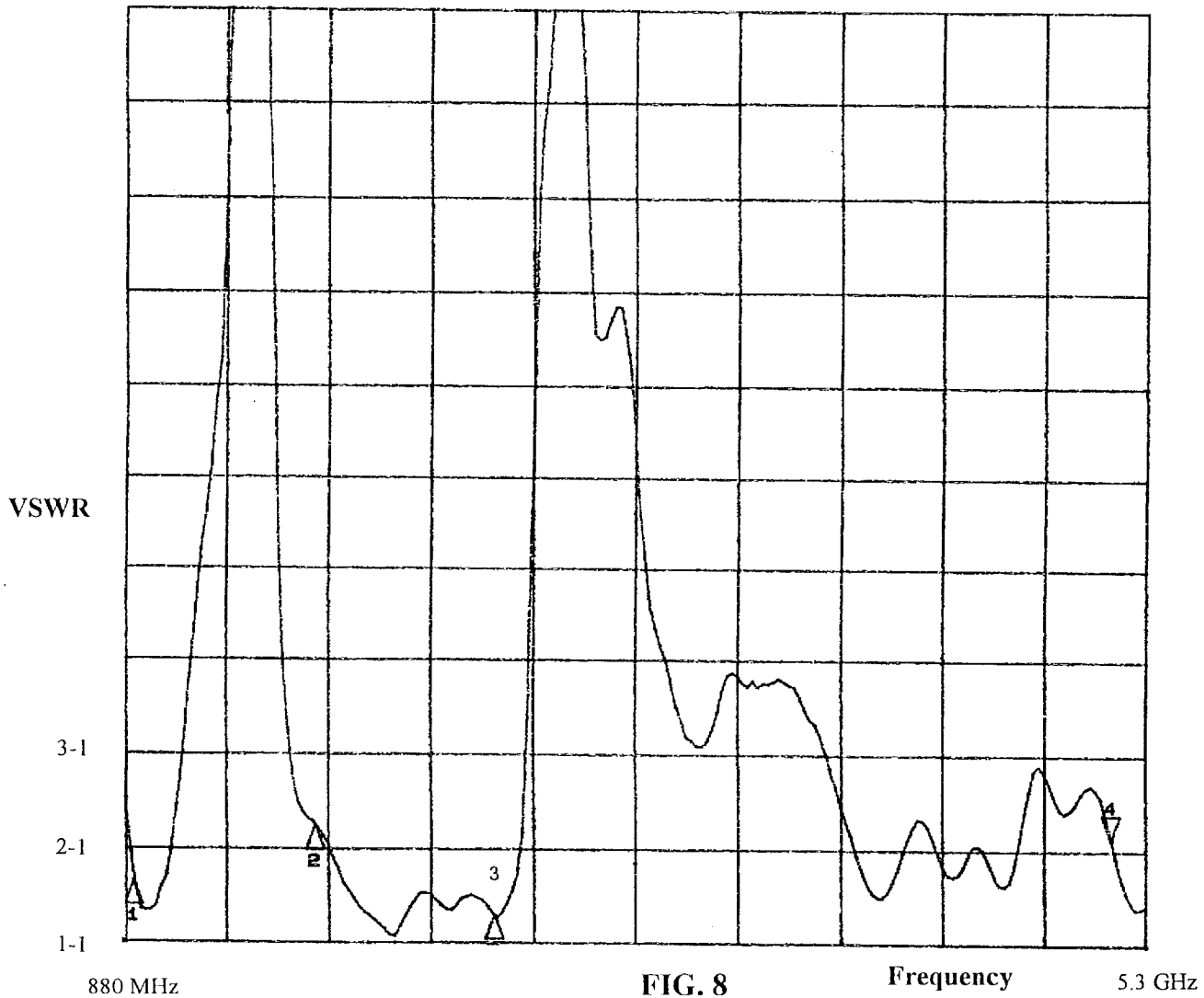
FIG. 8 is the VSWR response of a practical embodiment of the invention having the dimensions set forth in FIGS. 4–7.

FIG. 8 is the VSWR response of a practical embodiment of an antenna according to the invention having the dimensions set forth in FIGS. 4–7. The curve shows that the VSWR is below 2.5–1 in the 880–960 MHz, 1850–1990 MHz, 2.4–2.5 GHz, and 5.15–5.25 GHz bands. The horizontal axis is frequency, starting at 880 MHz and ending at 5,300 MHz (5.3 GHz). The vertical axis is VSWR ratio starting at 1-1 with each division increasing the ratio by one (i.e., the second line indicates a VSWR of 2-1). The first marker frequency is 920 MHz, the second marker frequency is 1.71 GHz, the third marker is 2.48 GHz and the fourth marker is 5.15 GHz.

We claim:

1. A multiband antenna operable in at least a first frequency band and a second frequency band higher in frequency than said first frequency band, comprising a dipole having a first conductive leg and a second conductive leg, adapted to be directly fed between the first and second legs, at least a portion of the first leg of said dipole having a meander configuration, said first leg having an electrical length of about one-quarter wavelength, or an odd multiple thereof, in said first frequency band and said second leg having an electrical length of about one-quarter wavelength, or an odd multiple thereof, or more in said first frequency band, and a non-driven parasitically-excited conductive element closely spaced to said first dipole leg and electrically connected to said second dipole leg, said parasitic element having an electrical length of about one-quarter wavelength, or an odd multiple thereof, in said second frequency band.

2. The antenna of claim 1 wherein said dipole legs and said element are conductive traces on a thin dielectric.

3. The antenna of claim 2 wherein said traces are on the same side of said dielectric.

4. The antenna of claim 2 wherein the physical width of said second leg is large with respect to its length in order to widen the antenna bandwidth in the first and second bands.

5. The antenna of claim 2 wherein said conductive traces and thin dielectric are conductive traces on a printed circuit board.

6. The antenna of claim 5 wherein said printed circuit board is rigid.

7. The antenna of claim 5 wherein said printed circuit board is flexible.

8. The antenna of claim 5 wherein said traces are on the same side of said printed circuit board, said antenna further comprising a further conductive trace on the other side of the printed circuit board, said further conductive trace electrically connected to the second leg of said dipole and extending under at least a portion of said second leg and under a portion of said parasitically-excited element.

9. The antenna of claim 5 wherein said traces are on the same side of said printed circuit board, said antenna further comprising a further conductive trace on the other side of the printed circuit board, said further conductive trace having no electrical connection to any other traces on said printed circuit board and extending under a portion of said parasitic element and under at least a portion of the space between the first leg and said parasitically-excited element.

10. The antenna of claim 5 wherein said traces are on the same side of a printed circuit board, said antenna further comprising two further conductive traces on the other side of the printed circuit board, one of said further conductive traces electrically connected to the second leg of said dipole and extending under at least a portion of said second leg and under a portion of said parasitically-excited element, the other of said further conductive traces having no electrical connection to any other traces on said printed circuit board and extending under a portion of said parasitic element and under at least a portion of the space between the first leg and said parasitically-excited element.

11. The antenna of claim 1 wherein the closest portions of the parasitically-excited element and the first dipole leg are spaced about 0.01 to 0.05 wavelength in the second frequency band.

12. The antenna of claim 1 wherein said dipole is an asymmetric dipole in which the electrical length of the second leg is greater than the electrical length of the first leg in said first frequency band.

13. The antenna of claim 12 wherein the configurations of the first and second legs are different from each other.

14. The antenna of claim 13 wherein the configuration of the second leg is substantially linear.

15. The antenna of claim 14 wherein the physical width of said second leg is large with respect to its length in order to widen the antenna bandwidth in the first frequency band.

16. The antenna of claim 1 wherein said second leg has an electrical length greater than the electrical length of said non-driven parasitically-excited element in said second frequency band.

17. The antenna of claim 16 wherein the configurations of the second leg and the non-driven parasitically-excited element are substantially similar.

18. The antenna of claim 17 wherein the configuration of the second leg and the non-driven parasitically-excited element are both substantially linear.

19. The antenna of claim 18 wherein the physical width of said second leg is large with respect to its length in order to widen the antenna bandwidth in the second frequency band.

20. The antenna of claim 1 wherein the first and second legs of the dipole are split and an unbalanced feed is applied to said dipole such that the first leg is fed by the hot side of the feed and the second leg is fed by the ground side of the feed.

21. The antenna of claim 20 wherein the split feed point of the dipole presents substantially the same feed point ohm impedance in said first and second frequency bands.

22. The antenna of claim 21 wherein said feed point impedance is nominally 50 ohms.

23. The antenna of claim 1 wherein the physical width of said parasitically-excited element is large with respect to its length in order to widen its bandwidth.

24. The antenna of claim 23 wherein the average length to width ratio of the parasitically-excited element is in the range of 3 to 10.

25. The antenna of claim 1 wherein said antenna is elongated, having a width substantially narrower than its length.

26. The antenna of claim 1 wherein said first frequency band is the 880–960 MHz band and the second frequency band is the 1850–1990 MHz band.

27. The antenna of claim 1 wherein said first frequency band is the 1850–1990 MHz band and the second frequency band is the 2.4–2.5 GHz band.

28. The antenna of any one of claims 1 and 20–24 wherein said first frequency band is the 880–960 MHz band and the second frequency band is the band of frequencies between 1850 MHz and 2.5 GHz band that includes the 1850–1990 MHz band and the 2.4–2.5 GHz band.

29. The antenna of claim 1 wherein said first frequency band is the 880–960 Mhz band and the second frequency band is the 5.15–5.25 GHz band.

30. A multiband antenna operable in at least a first frequency band and a second frequency band higher in frequency than said first frequency band, comprising a dipole having a first leg and a second leg, adapted to be directly fed between the first and second legs, at least a portion of the first leg of said dipole having a meander configuration, said first leg having an electrical length of about one-quarter wavelength, or an odd multiple thereof, in said first frequency band and said second leg having an electrical length of about one-quarter wavelength, or an odd multiple thereof, or more in said first frequency band, wherein the legs of said dipole are conductive traces on the first side of a thin dielectric, and a further conductive trace on the second side of the thin dielectric located underneath a portion of the meander configuration, the further conductive trace having no connection to any other trace, said further conductive trace shaped, sized and positioned under said meander portion so as to create an LC trap that electrically decouples a portion of the first leg when the antenna operates in said second frequency band such that the remaining portion of the first leg has an effective electrical length of about one-quarter wavelength, or an odd multiple thereof, in said second frequency band.

31. The antenna of claim 30 wherein at least a portion of the meander configuration folds back on itself at least twice and wherein said further conductive trace is located underneath a portion of the meander portion of the first leg that folds back upon itself at least twice.

32. An antenna according to claim 31 wherein said meander portion that folds back on itself at least twice has three segments generally parallel to each other in which at least two of the segments are substantially linear.

33. The antenna of claim 30 wherein the physical width of said second leg is large with respect to its length in order to widen the antenna bandwidth in the first and second bands.

34. The antenna of claim 30 wherein said dipole is an asymmetric dipole in which the electrical length of the second leg is greater than the electrical length of the first leg in said first frequency band.

35. The antenna of claim 34 wherein the configurations of the first and second legs are different from each other.

36. The antenna of claim 35 wherein the configuration of the second leg is substantially linear.

37. The antenna of claim 36 wherein the physical width of said second leg is large with respect to its length in order to widen the antenna bandwidth in the first frequency band.

38. The antenna of claim 30 wherein the first and second legs of the dipole are split and an unbalanced feed is applied to said dipole such that the first leg is fed by the hot side of the feed and the second leg is fed by the ground side of the feed.

39. The antenna of claim 38 wherein the split feed point of the dipole presents substantially the same feed point ohm impedance in said first and second frequency bands.

40. The antenna of claim 39 wherein said feed point impedance is nominally 50 ohms.

41. The antenna of claim 30 wherein said first frequency band is the 880–960 MHz band and the second frequency band is the 1850–1990 MHz band.

42. The antenna of claim 30 wherein said first frequency band is the 1850–1990 MHz band and the second frequency band is the 2.4–2.5 GHz band.

43. A multiband antenna operable in at least a first frequency band, a second frequency band higher in frequency than said first frequency band, and a third frequency band higher in frequency than the first and second frequency bands, comprising a dipole having a first leg and a second leg, adapted to be directly fed between the first and second legs, at least a portion of the first leg of said dipole having a meander configuration, said first leg having an electrical length of about one-quarter wavelength, or an odd multiple thereof, in said first frequency band and said second leg having an electrical length of about one-quarter wavelength, or an odd multiple thereof, or more in said first frequency band, a non-driven parasitically-excited element closely spaced to said first dipole leg and electrically connected to said second dipole leg, said parasitic element having an electrical length of about one-quarter wavelength, or an odd multiple thereof, in said second frequency band, wherein said dipole and said parasitically-excited element are conductive traces on the same side of a thin dielectric, and a further conductive trace on the second side of the thin dielectric located underneath a portion of the meander configuration, the further conductive trace having no connection to any other, said further conductive trace shaped, sized and positioned under said meander portion so as to create an LC trap that electrically decouples a portion of the first leg when the antenna operates in said third frequency band such that the remaining portion of the first leg has an effective electrical length of about one-quarter wavelength, or an odd multiple thereof, in said third frequency band.

44. The antenna of claim 43 wherein the physical width of said second legs is large with respect to its length in order to widen the antenna bandwidth in the first and second bands.

45. The antenna of claim 43 wherein said conductive traces and thin dielectric are conductive traces on a printed circuit board.

46. The antenna of claim 45 wherein said printed circuit board is rigid.

47. The antenna of claim 45 wherein said printed circuit board is flexible.

48. The antenna of claim 43 wherein the closest portions of the parasitically-excited element and the first dipole leg are spaced about 0.01 to 0.05 wavelength in the second frequency band.

49. The antenna of claim 43 wherein said dipole is an asymmetric dipole in which the electrical length of the second leg is greater than the electrical length of the first leg in said first frequency band.

50. The antenna of claim 43 wherein the first and second legs of the dipole are split and an unbalanced feed is applied to said dipole such that the first leg is fed by the hot side of the feed and the second leg is fed by the ground side of the feed.

51. The antenna of claim 50 wherein the split feed point of the dipole presents substantially the same feed point ohm impedance in said first and second frequency bands.

52. The antenna of claim 51 wherein said feed point impedance is nominally 50 ohms.

53. The antenna of claim 43 wherein the average length to width ratio of the parasitically-excited element is in the range of 3 to 10.

54. The antenna of claim 43 wherein said antenna further comprising a further conductive trace on the second side of the thin dielectric, said further conductive trace electrically connected to the second leg of said dipole and extending under at least a portion of said second leg and under a portion of said parasitically-excited element.

55. The antenna of claim 43 wherein said antenna further comprising a further conductive trace on the second side of the printed circuit board, said further conductive trace having no electrical connection to any other traces on said printed circuit board and extending under a portion of said parasitic element and under at least a portion of the space between the first leg and said parasitically-excited element.

56. The antenna of claim 43 wherein said antenna is elongated, having a width substantially narrower than its length.

57. The antenna of claim 43 wherein said first frequency band is the 880–960 MHz band, the second frequency band is the band of frequencies between 1850 MHz and 2.5 GHz band that includes the 1850–1990 MHz band and the 2.4–2.5 GHz band, and the third frequency band is the 5.15–5.25 GHz band.

* * * * *